United States Patent [19]

Taniguchi et al.

[11] Patent Number: 4,894,688

[45] Date of Patent: Jan. 16, 1990

[54] DEVICE FOR CIRCULATING DEVELOPER

[75] Inventors: Masami Taniguchi; Junichi Takamatsu, both of Osaka, Japan

[73] Assignee: Mita Industrial Co., Ltd., Osaka, Japan

[21] Appl. No.: 161,646

[22] Filed: Feb. 29, 1988

[30] Foreign Application Priority Data

| | | | |
|---|---|---|---|
| Mar. 3, 1987 | [JP] | Japan | 62-49603 |
| Mar. 3, 1987 | [JP] | Japan | 62-49604 |
| Mar. 3, 1987 | [JP] | Japan | 62-49605 |
| Mar. 3, 1987 | [JP] | Japan | 62-49608 |
| Mar. 3, 1987 | [JP] | Japan | 62-49609 |

[51] Int. Cl.[4] ..... G03G 15/08

[52] U.S. Cl. ..... 355/298; 355/296; 355/301; 355/244

[58] Field of Search ..... 355/3 R, 15, 3 DD, 140; 358/298, 296, 244, 301

[56] References Cited

U.S. PATENT DOCUMENTS

| | | | |
|---|---|---|---|
| 3,752,576 | 8/1973 | Gerbasi | 355/15 |
| 4,395,114 | 7/1983 | Ura et al. | 355/15 |
| 4,593,997 | 6/1986 | Fox et al. | 355/15 |
| 4,627,716 | 12/1986 | Oka | 355/15 |
| 4,659,212 | 4/1987 | Ichihara et al. | 355/15 |
| 4,660,960 | 4/1987 | Fukunaga et al. | 355/3 DD |
| 4,696,565 | 9/1987 | Imanaka | 355/15 |
| 4,724,459 | 2/1988 | Ford | 355/15 X |
| 4,768,055 | 8/1988 | Takamatsu et al. | 355/3 R |

FOREIGN PATENT DOCUMENTS

| | | |
|---|---|---|
| 2813556 | 10/1978 | Fed. Rep. of Germany . |
| 2923394 | 12/1979 | Fed. Rep. of Germany . |
| 3021053 | 12/1981 | Fed. Rep. of Germany . |
| 59-61861 | 4/1984 | Japan . |
| 60-41079 | 3/1985 | Japan . |
| 60-163067 | 8/1985 | Japan . |

*Primary Examiner*—A. C. Prescott

*Attorney, Agent, or Firm*—Jordan and Hamburg

[57] ABSTRACT

A device for use with an image forming apparatus having a photosensitive drum and a developing device and a cleaning device disposed around the photosensitive drum for conducting developer recovered in the cleaning device to the developing device includes a circulating passage provided between the developing device and the cleaning device so as to communicate the developing device with the cleaning device. A discharging device discharges developer recovered in the cleaning device to the circulating passage, and a conveyor is disposed in the circulating passage to convey developer in the circulating passage to the developing device, the conveyor and the circulating passage being constructed to provide a space between the conveyor and the circulating passage such that a portion of the developer is allowed to be temporarily retained in such space. A supply device is provided for supplying developer conveyed by the developer into the developing device.

32 Claims, 11 Drawing Sheets

DEVICE FOR CIRCULATING DEVELOPER

BACKGROUND OF THE INVENTION AND RELATED ART STATEMENT

The present invention relates to a device for circulating developer for use with an image forming apparatus such as a copying machine, facsimile apparatus or the like, which conveys developer from a cleaning device into a developing device for reuse.

It is generally known that in an image forming apparatus such as a copying machine, residual developer remained on a photosensitive drum after image transfer operation is removed and recovered with a cleaning device. To reuse recovered developer, a developer circulating device for conveying developer from a cleaning device into a developing device has been used.

FIG. 11 shows a prior art device of this type having a developing device 102 and a cleaning device 103 both mounted around a photosensitive drum 101, and a circulating passage 104 which is provided between the developing device 102 and the cleaning device 103 so as to communicate with both devices. The cleaning device 103 accommodates a discharging screw 107 by which developer is discharged to the circulating passage 104 from the cleaning device 108.

The circulating passage 104 has a wall 104*a* at its terminal end. Beneath the wall 104*a* is provided an opening 102*a* as an entrance to the developing device 102. A supplying screw 105 for supplying developer through the opening 102*a* into the developing device 102 extends transversely of the developing device 102. The supplying screw 105 is formed into a spiral extending in a direction throughout the length thereof. Rotation of the supplying screw 105 supplies developer from a side of the developing device 102 into the developing device 102.

The circulating passage 104 has a spiral conveying member 106 placed therein and extending to the terminal end thereof. The conveying member 106 is rotated so that developer is conveyed from the cleaning device 103 to the developing device 102. The supplying screw 105, the conveying member 106, and the discharging screw 107 are interrelatedly driven synchronously with a main motor.

The problem arising in this prior art circulating device are as follows:

(1) All the developer conveyed by the conveying member 106 to the terminal end of the circulating passage 104 is not always supplied through the opening 102*a* into the developing device 102. When the fluidity of developer lowers, for instance, due to a high humidity, developer is liable to adhere to the surface of the conveying member 106 and be conveyed onto the wall 104*a* without flowing into the opening 102*a*. Consequently, developer is deposited in the terminal portion of the conveying member 106 with being pressed continuously against the wall 104*a*. This causes the conveying member 106 to inadvertently stop rotating and the drive of the conveying member 106 is liable to come into a lock state.

(2) In the prior art device, the supplying screw 105 is driven together with the conveying member 106 and the discharging screw 107 during the operation of the main motor or of the photosensitive drum 101. This causes excessive agitation of toner in the developing device 102 which results in deformation and blocking of toner particles.

It has been seen that this problem can be solved by controlling the supplying screw 105, the conveying member 106, the discharging screw 107, and a toner supply device for supplying used toner into the developing device 102 in accordance with the density of toner in the developing device, as disclosed in Unexamined Patent Publication No.133480/1985. However, in the device, the discharging screw 107 is driven only when toner is fed. Since toner in the cleaning device 103 is recovered and discharged only during the supply of toner, toner is liable to be left in the cleaning device 103 and be deposited on a lower blade for closing a clearance between the photosensitive drum 101 and the cleaning device 103. Consequently, the lower blade is pressed downward by the deposited toner, which produces an undesirable space between the photosensitive drum 101 and the cleaning device 103. In addition, a further problem occurs which residual toner is liable to produce blocks of toner in the cleaning device 103.

(3) As the supplying screw 105 is formed into the aforesaid spiral extending in one direction throughout the length thereof, developer supplied into the developing device 102 is conveyed in only one direction toward the downstream portion of the supplying screw 106 or a furthermost portion of the developing device 102. This allows developer to be supplied unevenly to the furthermost portion of the developing device 102, which results in a reduced storage efficiency. When developer is conveyed in only one direction, it is pressed against the furthermost wall of the developing device 102 and deposited in the downstream portion of the supplying screw 105 to cause the supplying screw 105 to come into a lock state.

(4) Unused developer contained in the developing device 102 prior to an initial operation is required to contain in an airtight condition to prevent it from deterioration. It is difficult in the prior art device to keep unused developer completely in an airtight condition as the developing device 102 and the cleaning device 103 are communicated with each other by the circulating passage 104. In particular, when the developing device 102 and the cleaning device 103 tilt during transportion, there is a likelihood that a portion of unused developer may flow through the circulating passage 104 into the cleaning device 103.

SUMMARY OF THE INVENTION

It is an object of the present invention to solve the problems and provide a device for circulating developer in an improved manner for reuse.

According to the present invention, a device for circulating developer recovered from a cleaning device to a developing device for reuse comprises a circulating passage provided between the developing device and the cleaning device, means for discharging developer recovered in the cleaning device to the circulating passage, means for conveying developer from the circulating passage to the developing device, and means for supplying developer conveyed by the conveying means into the developing device. The circulating passage has a space for allowing a portion of developer to stay temporarily so that a portion of developer adhering to the conveying means can remain in the space without being deposited in the terminal portion of the conveying means. Accordingly, the drive of the conveying means is not inadvertently stopped by deposited developer which is produced due to a fact that high humidity causes the fluidity of developer to lower, which assures satisfactory and stable circulating operation of developer.

Also, according to the present invention, the conveying means is arranged such that the conveying amount of developer is smaller in the downstream portion than in the upstream portion. Consequently, even when developer adheres to the conveying means, it does not occur that developer is pressed against the terminal end wall to be deposited in the terminal portion of the conveying means. This is because the conveying amount of developer is small in the terminal portion. Consequently, satisfactory and stable circulation of developer can be accomplished as mentioned above.

Further, according to the present invention, the amount of developer supplied from the circulating passage into the developing device is greater than that discharged from the cleaning device to the circulating passage. Consequently, even when developer adheres to the conveying means, it does not occur that developer is pressed against the terminal wall to be deposited in the terminal portion of the conveying means. Consequently, satisfactory and stable circulation of developer can be accomplished as mentioned above.

Further, according to the present invention, the discharging means and the conveying means are driven at least during the operation of a photosensitive drum, and the supplying means and means provided in the developing device for supplying developer to a developing section are held in an operational relation and controlledly driven. Consequently, toner recovered in the cleaning device is discharged without depositing. Developer is properly supplied into the developing device. Since the supplying means is driven only at a desirable time, excessive agitation of developer in the developing device can be prevented. Consequently, satisfactory and stable circulation of developer can be accomplished.

Further, according to the present invention, a supplying member for supplying developer conveyed from the cleaning device into the developing device is provided transversely of the developing device so that as the supplying member rotates, developer can be supplied into the developing device from one side. The supplying member has a spiral blade in the upstream portion in order to convey developer toward the furthermost of the developing device. Also, the supplying member has in the downstream portion another spiral blade whose direction is opposite to that of the spiral provided in the upstream portion. Furthermore, the supplying member has in the intermediate portion a plurality of plates extending axially of the supplying member. In this construction, developer is supplied into the developing device from one side and conveyed to the furthermost portion of the developing device along the plates of the intermediate portion. Then, developer is given a counter conveying force in the downstream portion of the supplying member. Consequently, developer is transversely uniformly supplied in the developing device without being deposited at a particular location of the developing device. Consequently, developer is not deposited in the downstream portion of the supplying member and the supplying member is prevented from inadvertently stopping, which assures satisfactory and stable circulation of developer.

Further, according to the present invention, the developing device is provided with a developer storage section defined by sealing member in which unused developer is airtightly stored. Also, the developing device is provided with a developer supplying section in opposite portion to the developer storage section. Consequently, the airtight of the developer storage section is assuredly held even when a circulating passage is provided. Also, even when the developing and cleaning devices tilt abruptly, there is not a likelihood that developer flows into the developing and cleaning devices. Thus, a device of the present invention, which is simple in construction, assures an airtight condition and satisfactory circulation of developer.

DETAILED DESCRIPTION OF PREFERRED EMBODIMENTS OF THE INVENTION

Preferred embodiments of the present invention will be described in conjunction with the accompanying drawings.

Figure 1:
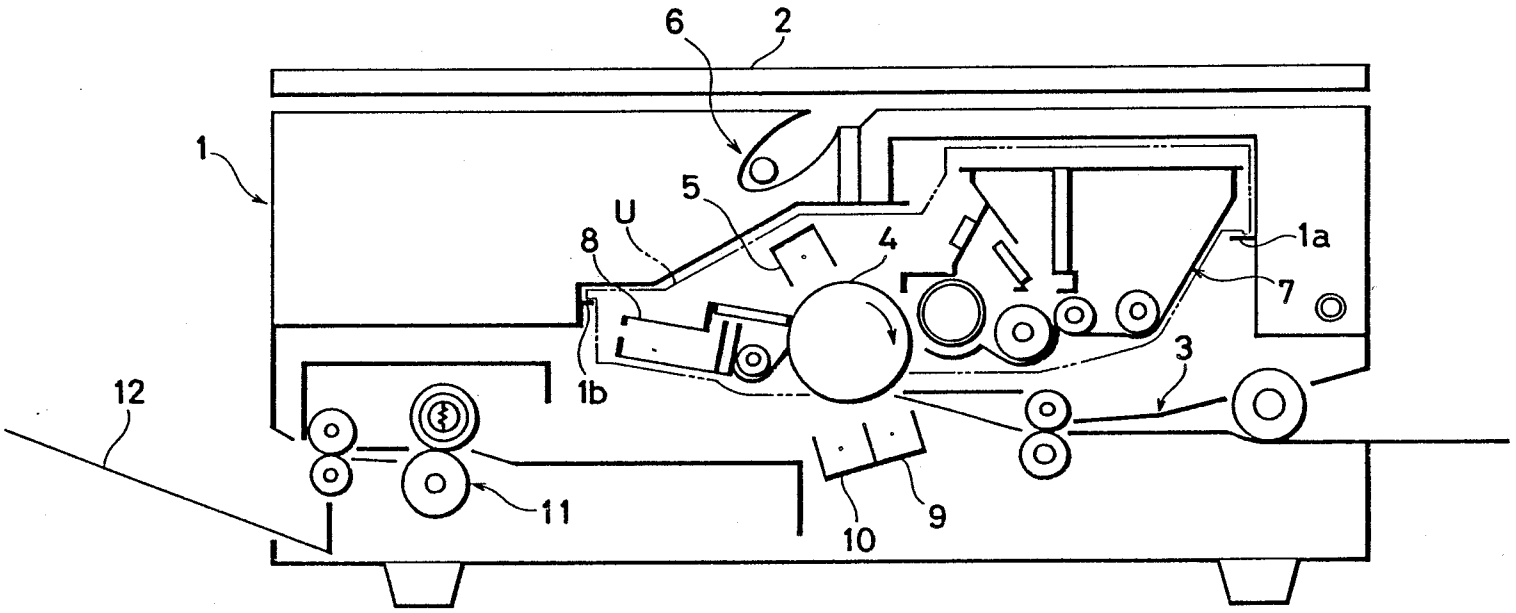
FIG. 1 is a structural view of a copying machine having a developer circulating device of the present invention.

As shown in FIG. 1, an electrostatic copying machine body 1, over the top of which an original holder 2 is provided, is provided with a paper feeding section 3, a photosensitive drum 4, a main charger 5, an exposure device 6, a developing device 7, a cleaning device 8, an image transfer charger 9, a removal charger 10, a fixing device 11, and a paper receiving tray 12. The photosensitive drum 4 is connected to a drive shaft of a main motor (not shown) for rotation in a direction represented by the arrow shown.

The photosensitive drum 4, the developing device 7, the cleaning device 8, etc are placed in a casing so as to constitute a replaceable process unit as shown in FIGS. 2 to 5. The unit U is detachably mounted to the copying machine body 1 by guiding it along rails 1*a* and 1*b* provided in the body 1. In the unit U, a cylindrical circulating passage 13 is mounted on one side of the developing and cleaning devices 7, 8 so as to communicate the devices 7 and 8 with each other. The circulating passage 13 includes a cylinder section 13*a* extending from the cleaning device 8 to the developing device 7 and two communicating section 7*a* (supplying section) and 8*a* which are oriented in directions at right angles to the cylinder section 13*a* and connected to the developing device 7 and the cleaning device 8 respectively. In the cylinder section 13*a*, is provided a spiral conveying member 14 which is driven for rotation.

The communicating section (supplying section) 7*a* is projected from one side of a casing of the developing device 7. The downstream portion of the cylinder section 13*a* is disposed above the communicating section 7*a* (see FIGS. 2 and 3) and the cylinder section 13*a* is communicated with the communicating section 7*a* through an opening 22 (a communicating way between the developing device and the circulating passage). A sealing sponge 41 is interposed between the cylinder section 13*a* and the communicating section 7*a*.

The developing device 7 has a developer storage section 15 in its upper portion. The developer storage section 15 includes an initial developer storage section 15*a* having an opening in the bottom portion for containing an initial developer made of toner and carrier and a toner storage section 15*b* having an opening in the bottom portion for containing toner only. A sealing member 16 is attached to the bottom of the developer storage section 15. In other words, the developer storage section 15 is defined by dividing an inner space of the developing device 7 with the sealing member 16.

The sealing member 16 is attached to the developer storage section 15 with one end 16*a* adhesively attached to a rear wall 15*c* of the developer storage section 15 and with its intermediate portion 16*b* adhesively attached to a front wall 15*d* of the developer storage section 15. The sealing member 16 is then folded back in the opposite direction at the intermediate portion 16*b* so that the other end 16*c* of the sealing member 16 can pass outward through a slit opening 45 in the unit U. The communicating section 7*a* and the opening 22 are opposite to the developer storage section 15 with the sealing member 16 put between the section 7*a* and section 15, in other words, in the downstream of the sealing member 16. Developer is contained in the developer storage section 15 airtightly sealed by the sealing member 16. When the end 16*c* of the sealing member 16 is pulled in a direction represented by the arrow shown in FIGS. 4 and 5, the sealing member 16 is moved to release the sealing.

A supplying member (supplying means) 17, a feeding roller (feeding means) 18, an agitating roller 19, and a developing roller 20 are mounted beneath the sealing member 16. A toner control sensor 21 for detecting the mixing ratio of toner and carrier of developer contained in the developing device 7 or the density of tone is mounted above the developing roller 20.

The supplying member 17, which is located in the upstream of the feeding roller 18 and beneath the toner storage section 15*b*, extends transversely of the developing device 7 from a position just below the opening 22 to the opposite side of the developing device 7 with the front portion being placed in the communicating section 7*a*. The supplying member 17 has a spiral blade 17*a* in the opening 22 portion (the upstream portion) and a spiral blade 17*b* in the opposite portion (the downstream portion). The spiral blade 17*b* is formed in the direction opposite to the spiral blade 17*a*. Also, the supplying member 17 has two plates 17*c* extending in axial directions in the intermediate portion. The supplying member 17 is rotated in a predetermined direction by drive means as will be described hereinafter to move toner from the communicating section 7*a* to the interior of the developing device 7 in the opening side portion and then gives a counter-conveying force to toner in the opposite portion.

The feeding roller 18 is located beneath a partition between the initial developer storage section 15*a* and the toner storage section 15*b* and is made in contact with a partition 23 and the bottom of a casing of the developing device 7 so as to define two chambers (left and right portions shown in FIGS. 4 and 5) in the developing device 7. When the feeding roller 18 is turned, toner is ted from the supplying member chamber to the developing roller chamber.

The rear ends of the supplying member 17 and the feeding roller 18 are projected outward from a casing of the developing device 7. Gears 24 and 25 are mounted on the projected ends respectively. A coupling gear 26 is disposed between the gears 24 and 25. The coupling gear 26 is connected to a motor for toner supply (drive means, not shown) through a controller 44. The supplying member 17 and feeding roller 18 are interrelatedly driven by the motor. The controller 44 controls the interrelated rotation of the supplying member 17 and feeding roller 18 according to the output of the toner control sensor 21 so that the toner in the developing device 7 is maintained uniform in density.

Figure 4:
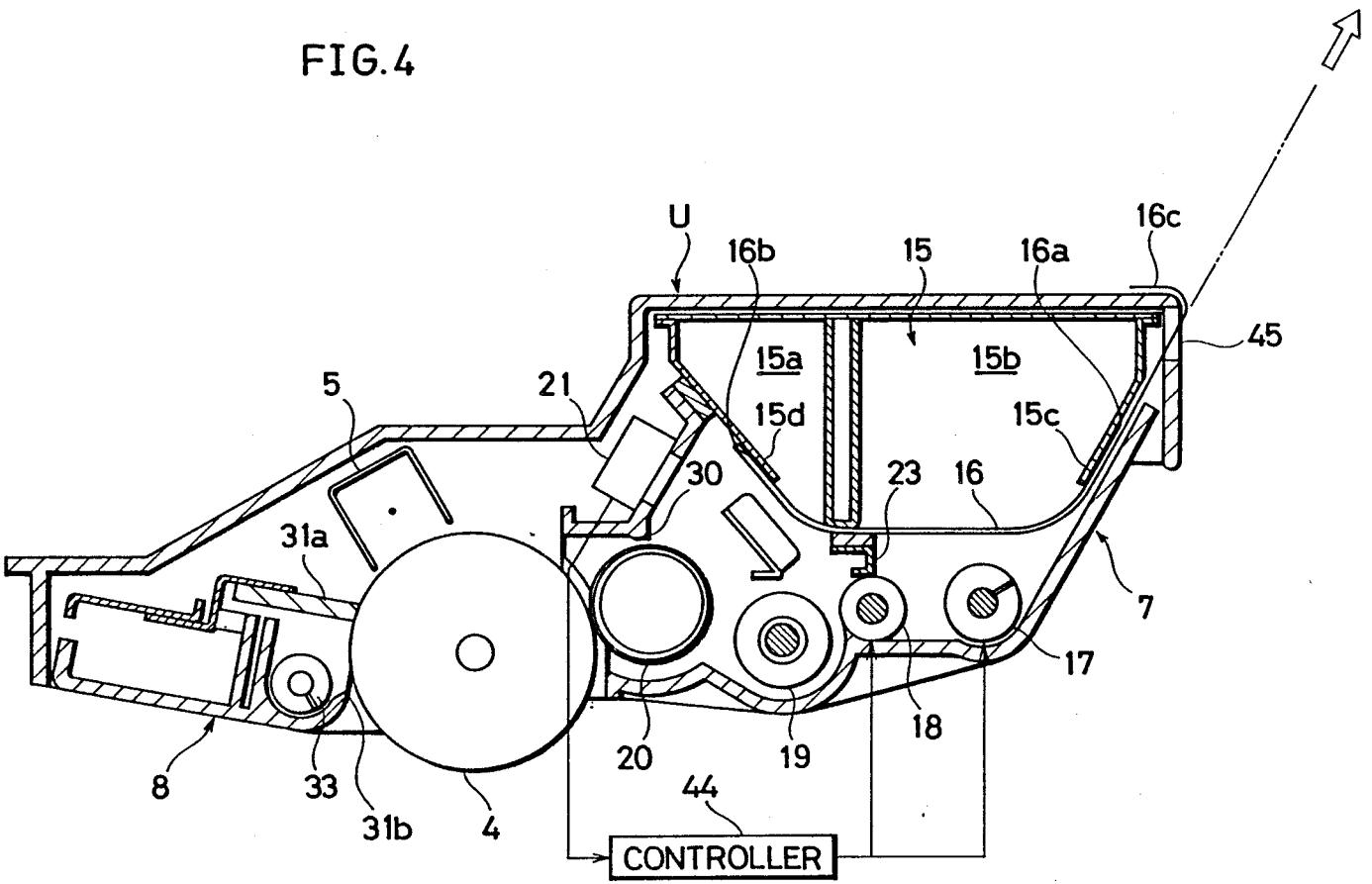
FIG. 4 is a sectional side view of the process unit.
Figure 5:
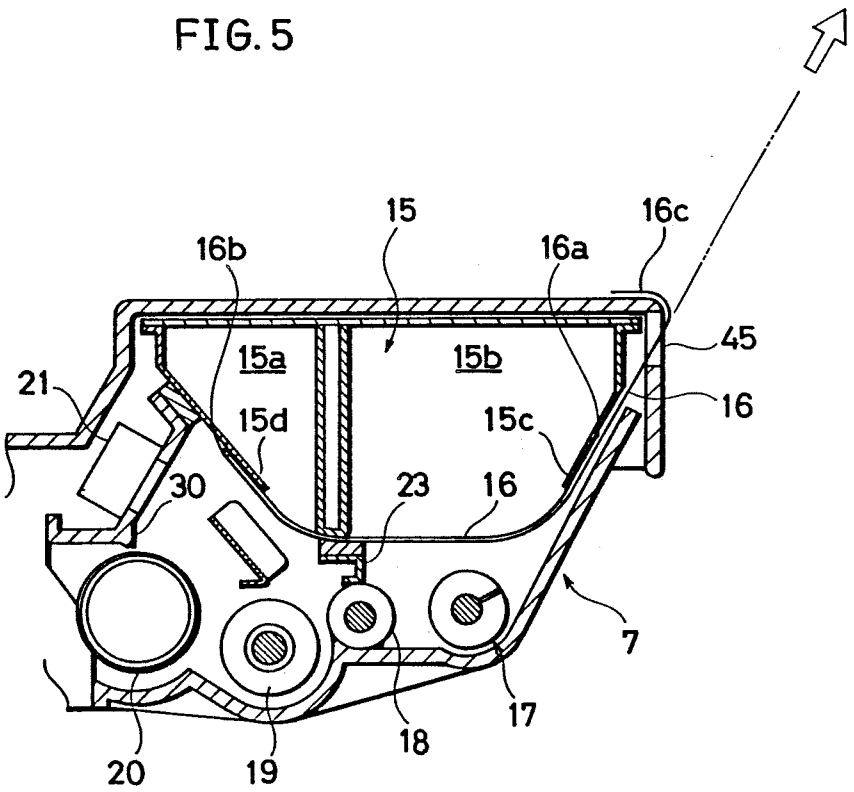
FIG. 5 is a section view of a developing device in the process unit.

Similarly, the rear ends of the developing roller 20 and the agitating roller 19 are attached with gears 27 and 28 respectively. A coupling gear 29 is disposed between the gears 27 and 28. The coupling gear 29 is connected to a driver so as to interrelatedly rotate the developing roller 20 and the agitating roller 19 in developing operation. As shown in FIGS. 4 and 5, the numeral 30 is a plate for cutting brushes of developer on the developing roller 20.

Figure 2:
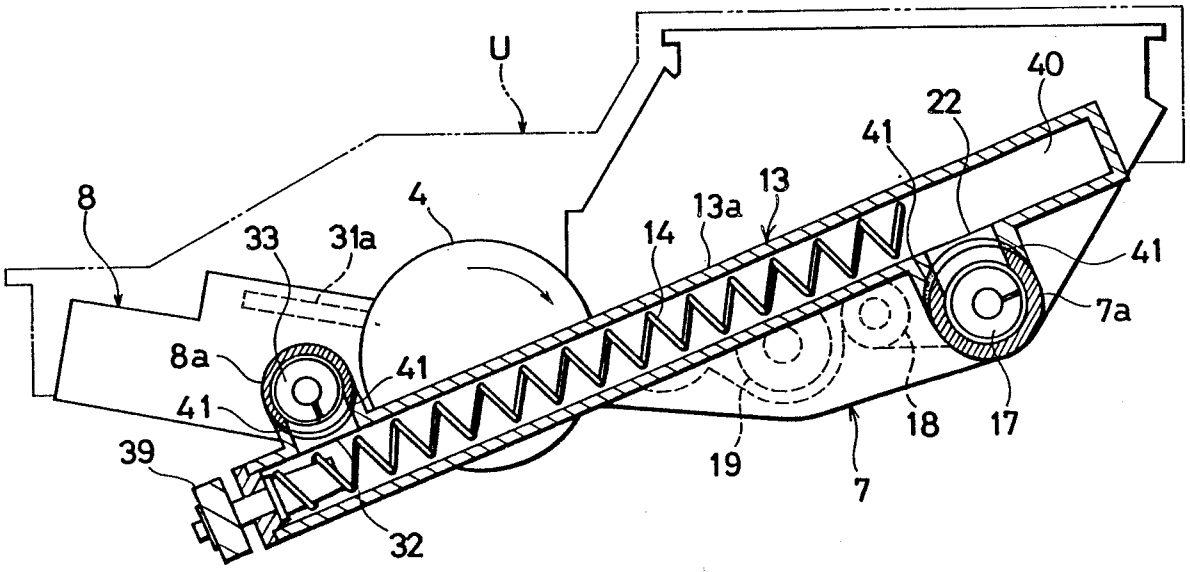
FIG. 2 is a cross sectional view taken along the line II—II of FIG. 3.
Figure 3:
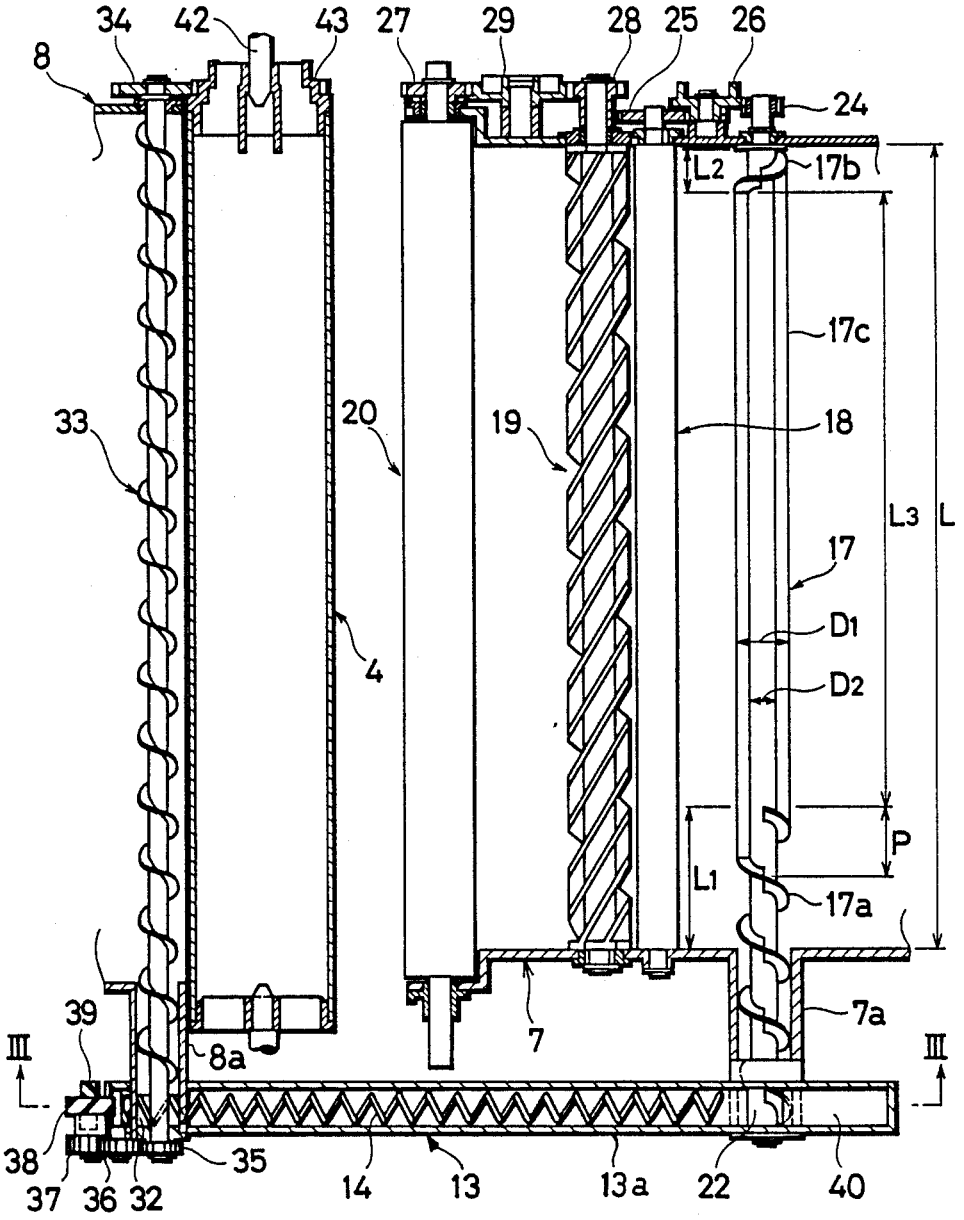
FIG. 3 is a sectional plan view of a process unit carrying the developer circulating device.

On the other hand, the cleaning device 8 is located in the downstream with respect to the developing device 7 in the rotational direction of the photosensitive drum 4 and adjacent to the periphery of the drum 4. The cleaning device 8 has a blade 31*a* for scraping residual toner from the photosensitive drum 4 after image transfer operation and a lower blade 31*b* for guiding the scraped toner to the bottom of the cleaning device 8. In addition, the cleaning device 8 has a tubular communicating section 8*a* projected from the side of the casing as the developing device 7. As shown in FIGS. 2 and 3, the upstream end of the cylinder section 13*a* is disposed beneath the communicating section 8*a* so that the communicating section 8*a* can communicate with the cylinder section 13*a* through an opening 32.

A discharging screw 33 (discharging means) for discharging recovered toner to the cylinder section 13*a* is mounted in the bottom of the cleaning device 8. The front portion of the discharging screw 33 is rotatably placed in the communicating section 8*a*. The front end is projected from the communicating section 8*a*. The projected end of the discharging screw 33 is attached with a gear 35. The opposite end is projected from the casing of the cleaning device 8 and attached with a gear 34 which is connected with a gear 43 mounted on a shaft 42 of the photosensitive drum 4. This arrangement allows the discharging screw 33 to carry the recovered toner from the cleaning device 8 toward the opening 32 with rotation of the photosensitive drum 4.

The conveying member 14 in the cylinder section 13*a* is made of a coil spring and connected with the discharging screw 33 through a gear 35 mounted on the front end of the discharging screw 33, an idler gear 36 meshed with the gear 35, a gear 37 meshed with the gear 36, a helical gear 38 mounted coaxially of the gear 37, and a helical gear 39 meshed with the gear 38 and connected to the conveying member 14. Accordingly, the conveying member is rotated together with the discharging screw 33 by the rotation of the photosensitive drum 4. The conveying member 14 is so shaped as to convey toner in the cylinder section 13*a* toward the developing device 7 during the operation.

While the end of the conveying member 14 is terminated just before the opening 22, the cylinder section 13*a* longitudinally extends across the opening 22 so that a space 40 is formed in the downstream portion of the terminal end of the conveying member 14 for temporarily receiving toner conveyed.

The operation of the device will be described. Prior to initial use of the process unit U, initial developer and toner are airtightly contained in the developer storage section 15 of the developing device 7. When the sealing member 16 is pulled in the direction represented by the arrow shown in FIGS. 4 and 5, initial developer is supplied in the developing roller chamber while toner is supplied in the supplying screw chamber. Then, when turning on a copy switch, the photosensitive drum 4 is rotated and the developing roller 20 and the agitating roller 19 are then interrelatedly driven, so that developing operation is started. The rotation of the photosensitive drum 4 is transmitted through the gears 43 and 34 to the discharging screw 33. Then, the rotation of the discharging screw 33 is transmitted through the gears 35, 36, 37, and helical gears 38, 39 to the conveying member 14. Accordingly, the discharging screw 33 and the conveying member 14 are rotated with the rotation of the photosensitive drum 4.

After developing is completed, residual toner on the photosensitive drum 4 is removed with the blade 31*a* and stored in the cleaning device 8. The stored toner is then discharged through the opening 32 to the cylinder section 13*a* by the discharging screw 33 rotating with the photosensitive drum 4.

The toner discharged to the cylinder section 13*a* is conveyed along the bottom of the cylinder section 13*a* toward the developing device 7 by the conveying member 14 driven in the manner described above. The toner is then supplied from the end of the conveying member 14 through the opening 22 to the communicating section 7*a* of the developing device 7.

On the other hand, the interrelated rotation of the supplying member 17 and the feeding roller 18 is controlled by controller in accordance with the density of toner. The controller 44 receives a signal from the toner control sensor 21. Consequently, the supplying member 17 moves the toner from the communicating section 7*a* to the inside of the developing device 7. The feeding roller 18 moves a mixture of toner from the supplying member 17 and toner from the toner storage section 15*b* to the developing roller 20.

The upstream portion of the supplying member 17 having the spiral blade 17*a* moves toner from the communicating section 7*a* to the inside of the developing device 7 and then to the furthermost area of the developing device 7 along the plates 17*c* on the central portion. The central portion of the supplying member 17 having the plates 17*c* agitates toner in the developing device 7 uniformly throughout the length thereof while moving toner to the feeding roller 18. In the furthermost area of the developing device, the downstream portion of the supplying member 17 having the spiral blade 17*b* formed in the opposite direction of the spiral blade 17*a* exerts a counter conveying force on the toner conveyed. Consequently, toner is conveyed backward to the central portion of the developing device 7, so that toner is uniformly supplied in the developing device 7.

The following advantages can be obtained with the use of the above-mentioned device.

(1) Conveyance by the conveying member 14

It has been seen that when the fluidity of toner lowers due to a high humidity, toner is conveyed with adhering to a conveying member 14. In a conventional device, toner is pressed and deposited in the terminal end of a conveying member. However, the device of the present invention allows the toner adhering to the conveying member 14 to move to the space 40, so that toner is not deposited in the terminal end of the conveying member 14. Consequently, toner can be assuredly circulated without stopping the conveying member 14 even when the fluidity of toner is low.

Figure 6:
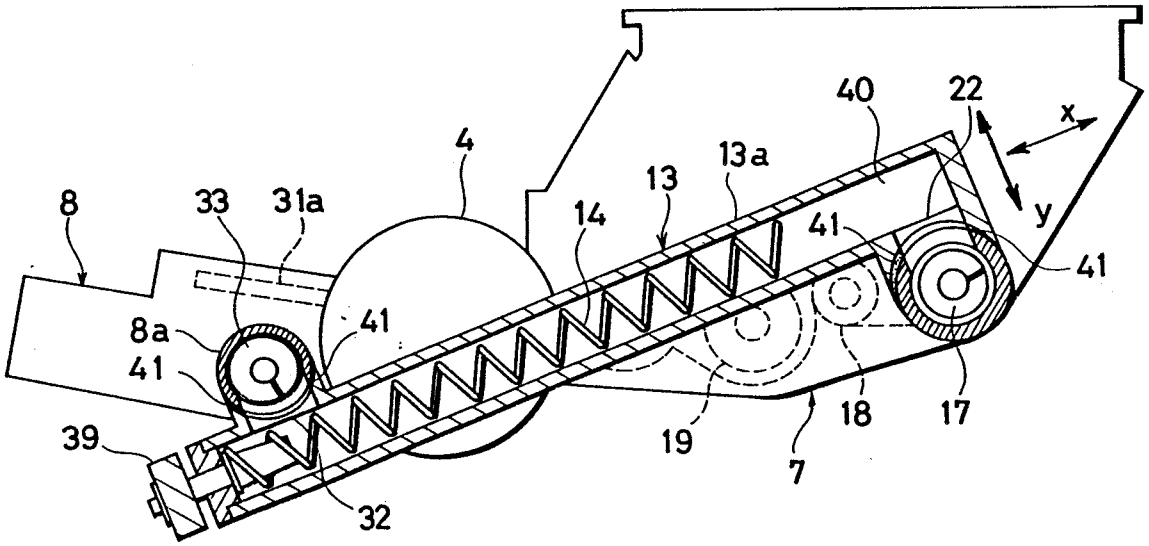
FIGS. 6, 7, 8, 9, and 10 are sectional side views of process units, each unit including a developer circulating device of the present invention.

The space 40 is not limited to a position of this embodiment. This effect is obtained by an arrangement in which a space 40 is disposed between the terminal end of the conveying member 14 and the opening 22 as shown in FIG. 6. The toner conveyed in the space 40 is supplied in the developing device 7 through the opening 22.

Also, a space may be formed in radial directions of the cylinder section 13*a* (Y-directions) in the downstream portion as well as a space 40 formed in longitudinal directions (X-directions) as shown in FIG. 6. Also, a space may be formed in both X and Y directions.

Figure 7:
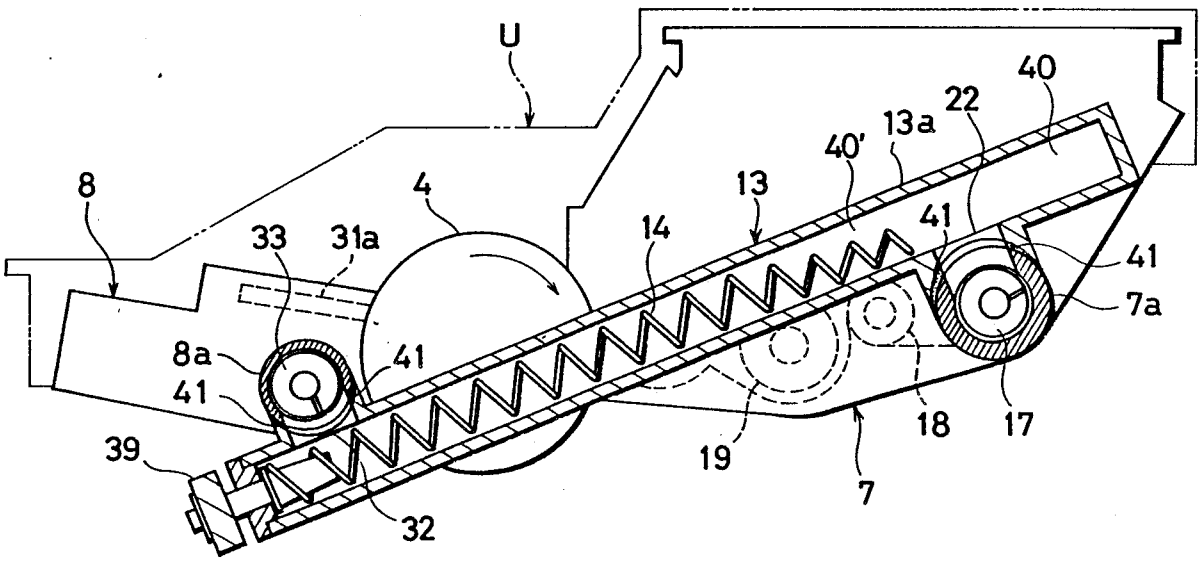
Figure 8:
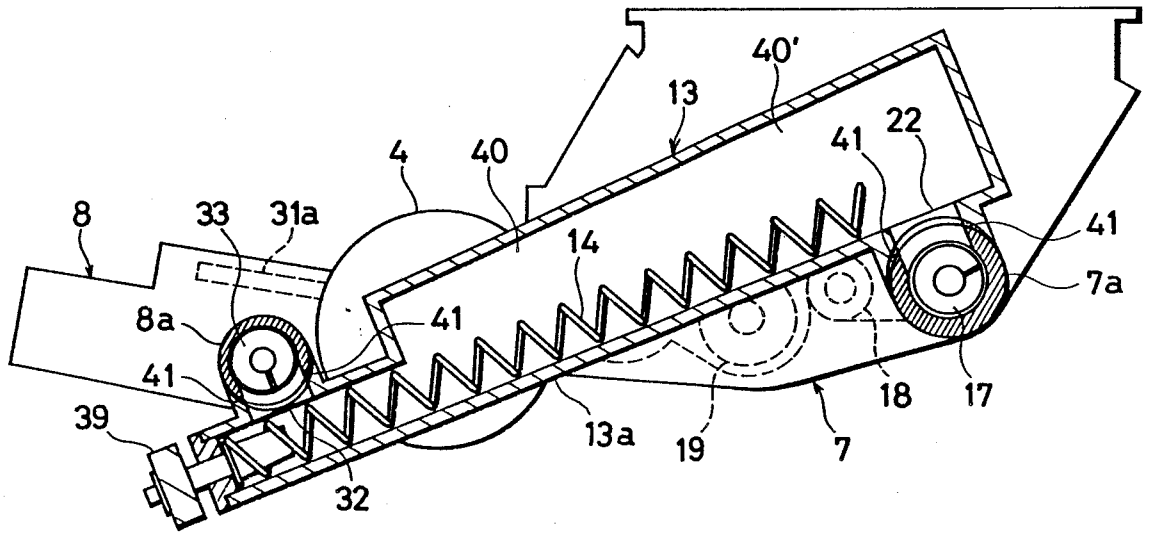

Moreover, as shown in FIG. 7, another space 40' may be formed in a position of the cylinder section 13*a* in which the terminal portion of the conveying member 14 is positioned by reducing the diameter of the terminal portion of the conveying member 14 so as to provide a reduced space 40 in the extended portion of the cylinder section 13*a*. Furthermore, as shown in FIG. 8, a space 40 may be formed above the conveying member 14 by expanding the cylinder portion 13*a* upwardly. As means for preventing the conveying member 14 from inadvertently stopping, there may be means for conveying smaller amount of toner in the terminal portion of the conveying member 14 than the upstream portion other than the provision of a space.

Figure 9:
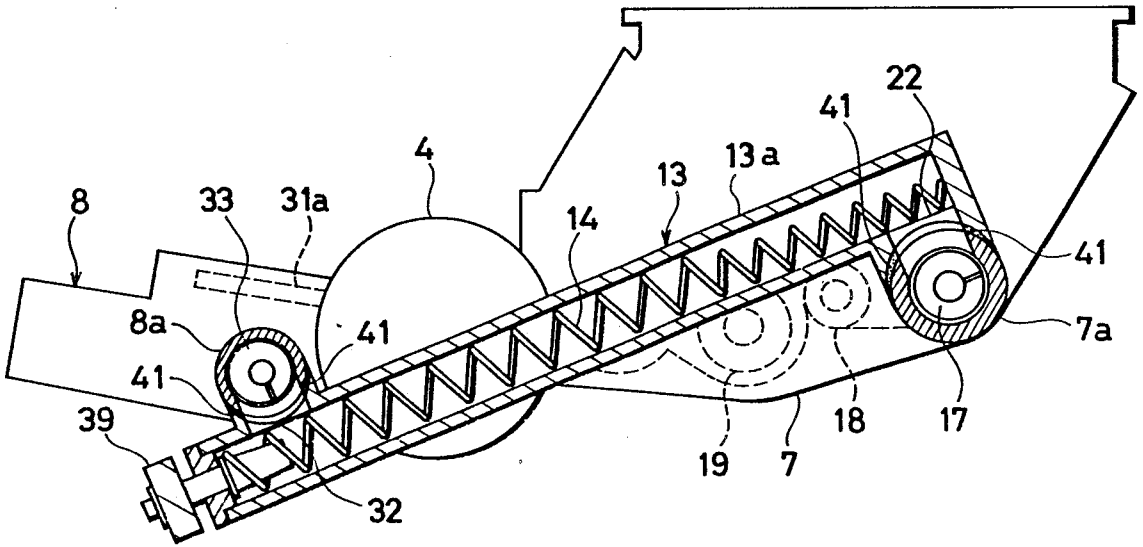
Figure 10:
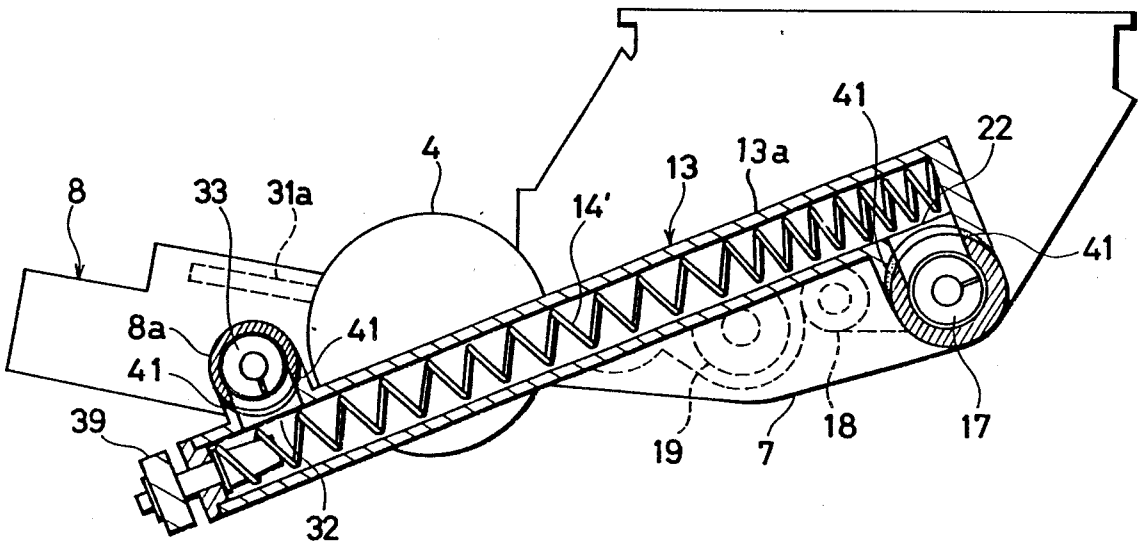
Figure 11:
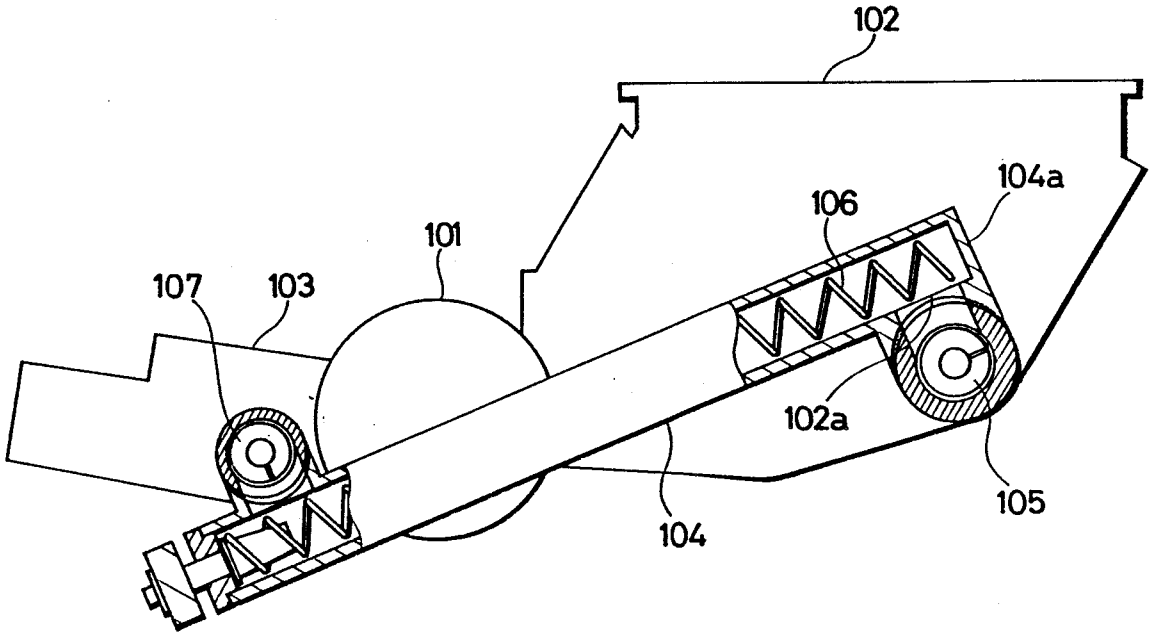
FIG.11 PRIOR ART
FIG. 11 is a partially sectional side view of a prior art device for circulating developer.

FIG. 9 shows a specific means in which the conveying member 14 is gradually narrowed from an intermediate portion toward the terminal portion. FIG. 10 shows another means in which the spiral pitch of a terminal portion is gradually reduced from an upstream portion to the terminal portion, so that the conveying speed of the terminal portion can become small.

Such construction in which the flow of toner is reduced in the terminal portion of the conveying member 14 allows a portion of toner to move in the upper of the cylinder section 13*a* at the terminal portion of the conveying member 14, so that a limited amount of toner is conveyed to the opening 22 along the lower portion of the circulating passage 13. Consequently, even under a condition in which the fluidity of toner lowers due to a high humidity, toner can be assuredly conveyed without inadvertently stopping the conveying member 14.

Furthermore, toner clogging can be eliminated in the terminal portion of the conveying member 14 by supplying large amount of toner with the supplying member 17 than with the discharging screw 33. In addition, a more improved circulation is obtained by executing this amount control In the device as shown in FIG. 2 6, 7, 8, 9, or 10.

The conveying member 14 may be made into a form which gradually decreases the conveying amount of toner toward its terminal end or a form which decreases the amount rapidly. When a spiral blade is used as a conveying member, the conveying amount of toner can also be decreased by reducing the difference between the inner diameter of a terminal portion of the spiral blade and the outer diameter of the same.

(2) Drive of the discharging screw 33, the supplying member 17, etc.

In the device of the present invention, the conveying member 14 and the discharging screw 33 are driven with the photosensitive drum 4, so that toner is not accumulated in the cleaning unit 8. This prevents a toner deposit which is liable to press down the lower blade 31*b* so as to bring about a clearance between the photosensitive drum 4 and the cleaning device 8 and also keeps toner in the cleaning device 8 from producing blocks. On the other hand, the supplying member 17 and the feeding roller 18 are driven at a required time in accordance with the density of toner. Consequently, the density of toner can be controlled with ease. Also, it is prevented to excessively agitate toner by the rotation of the supplying member 17 in the developing device 7.

The device in which the supplying member 17 is provided in the upstream of the feeding roller 18 so that circulated toner is not supplied directly to the developing roller 20 eliminates a likelihood that paper pieces contained in circulated toner come into developer.

Although the drive of the conveying member 14 and the discharging screw 33 is separated from the drive of the supplying member 17 and the feeding roller 18 in a drive system of the device, the two driving systems may be connected to a common drive power by providing clutches in respective systems so that the two driving systems are separately driven by the single drive power.

It will be noted that the conveying member 14 and the discharging screw 33 are not required to rotate with the photosensitive drum 4. Also, the conveying member 14 and the discharging screw 33 are not required to rotate with each other. Further, it will be noted that a phrase "driven at least during operation of the photosensitive drum" set forth in claims of the present invention means that it is allowable to drive the conveying member 14 and the discharging screw 33 during the non-operation of the photosensitive drum, but does not mean that it is strictly required to drive the conveying member 14 and the discharging screw 33 during the operation of the photosensitive drum. Accordingly, the drive of the conveying member 14 and the discharging screw 33 may be started later than the drive of the photosensitive drum 4 or stopped earlier as far as toner recovered in the cleaning device 8 is conveyed smoothly and without being accumulated due to the rotation of the photosensitive drum 4.

(3) Form of the supplying member 17

In the device, toner supplied in the developing device 7 is uniformly conveyed transversely of the developing device 7 without gathering in one side as the amount of toner becomes greater in the center portion of the supplying member 17 by virtue of the opposite conveying forces produced by the spiral blades 17*a* and 17*b* mounted on the opposite ends of the supplying member 17. Consequently, the likelihood is eliminated which toner is pressed and accumulated in the downstream portion of the supplying member 17 and the supplying member 17 is inadvertently stopped.

TABLE 1

| | |
|---|---|
| Dimension L between the opposite inner side walls of the developing device 7 | 218 mm |
| Dimension L1 between downstream end of the blade 17a and upstream side wall of the developing device 7 | 39 mm |
| Dimension L2 between upstream end of the blade 17b and downstream side wall of the developing device 7 | 15 mm |
| Dimension L3 between downstream end of the blade 17a and upstream end of the blade 17b | 164.5 mm |
| Outer diameter D1 of the blades 17a and 17b | 13 mm |

TABLE 1-continued

| | |
|---|---|
| Inner diameter D2 of the blades 17a and 17b | 7 mm |
| Pitch p of the spiral blades 17a and 17b | 15 mm |
| (Rotation number of the supplying member 17: 71.4 rpm) | |

Since toner is uniformly agitated by the plates 17*c* provided on the central portion of the supplying member 17 and then thrown to the feeding roller 18, an ideal flow of toner in the developing device 7 is produced.

The mounting position of the spiral blades 17*a* and 17*b* and the plates 17*c* is appropriately determined in accordance with the supplying speed of toner of the supplying member 17 and the size of the developing device 7. Table 1 shows an example of the size of a supplying member 17 which is confirmed by experimental operations to obtain the aforesaid effect (see also FIG. 3). Although the blade 17*a* shown in FIG. 3 is made by connecting single blades with one another, the same effect may be obtained by using a blade made of a continuous blade.

(4) Sealing of developer

In the device, the sealing member 16 is provided in such a way as to locate between the communicating section 7*a* by which the circulating passage 13 communicates with the developing device 7 so that developer can be supplied by the supplying member 17 in the developing device 7 and the developer storage section 15. Accordingly, the developer in the developer storage section 15 is airtightly sealed by the sealing member 16 prior to initial use of the developing device 7 and can be easily changed into use-state by pulling out the sealing member 16. Consequently, there is not a likelihood that before use, developer flows into the cleaning device 8 when the process unit U tilts.

In a construction in which the communicating section 7*a* is disposed in a chamber having the toner storage section 15*b*, there is a likelihood that circulated toner is supplied over unused toner contained in the toner storage section 15*b* to form a layer of circulated toner over a layer of unused toner, then causing the quality of image to abruptly lower due to the difference between the layers. In the device in which the communicating section 7*a* is provided in the lower portion of the developing device 7 as described above, circulated toner supplied in the developing device 7 is easily mixed with unused toner. Accordingly, image of high quality can be constantly produced.

The communicating section 7*a* may be provided in the downstream of the feeding roller 18. However, in the abovementioned device in which the communicating section 7*a* is provided in the upstream of the feeding roller 18, the circulated toner is not fed directly to the developing roller 20. Accordingly, there is little likelihood that paper pieces contained in the circulated toner come into developer.

We claim:

1. A device for use with an image forming apparatus having a photosensitive drum and a developing device and a cleaning device disposed around said photosensitive drum for conducting developer recovered in said cleaning device to said developing device comprising:

a circulating passage means provided between said developing device and said cleaning device so as to communicate said developing device with said cleaning device;

discharging means for discharging developer recovered in said cleaning device to said circulating passage means;

conveying means disposed in said circulating passage means for conveying developer in said circulating passage means to said developing device, said conveying means and said circulating passage means being constructed to provide a space between said conveying means and said circulating passage means such that a portion of the developer is allowed to be temporarily retained in said space; and supplying means for supplying developer conveyed by said conveying means into said developing device.

2. A device according to claim 1, wherein said circulating passage means has a downstream terminating end, said conveying means having a downstream terminating end, said space being located between said downstream terminating end of said conveying means and said downstream terminating end of said circulating passage means.

3. A device according to claim 1, wherein said circulating passage means comprises an elongated cylinder, said elongated cylinder having first communicating means communicating with said cleaning means and second communicating means communicating with said supplying means.

4. A device according to claim 3, wherein said circulating passage means has a downstream terminating end, said second communicating means being displaced from said downstream terminating end of said circulating passage means, said space being disposed between said second communicating means and said downstream terminating end of said circulating passage means.

5. A device according to claim 4, wherein said conveying means has a downstream terminating end which is juxtaposed to said second communicating means.

6. A device according to claim 3, wherein said circulating passage means has a downstream terminating end which is juxtaposed to said second communicating means, said conveying means having a downstream terminating end, said downstream terminating end of said conveying means being displaced from said second communicating means, said space being disposed between said downstream terminating end of said conveying means and said second communicating means.

7. A device according to claim 3, wherein said circulating passage means has a downstream terminating end which is juxtaposed to said second communicating means, said conveying means having a downstream terminating end, said downstream terminating end of said conveying means being displaced from said second communicating means, said space being disposed between said downstream terminating end of said conveying means and said downstream terminating end of said circulating passage means.

8. A device according to claim 1, wherein said circulating passage means has a substantially constant inner diameter along its longitudinal length, said conveying means having a conveyor portion having an outer diameter less than said constant diameter, said space being disposed radially outwardly of said conveyor portion.

9. A device according to claim 1, wherein said conveying means has a substantially constant outer diameter along its longitudinal length, said circulating passage means having a passage portion having an inner diameter greater than said constant diameter, said space being disposed radially inwardly of said passage portion.

10. A device according to claim 1, wherein said supplying means is operable to move more developer than said discharging means.

11. A device according to claim 1, wherein said developing device and said cleaning device constitute a process unit which is detachably mounted on said image forming apparatus.

12. A device for use with an image forming apparatus having a photosensitive drum and a developing device and a cleaning device disposed around said photosensitive drum for conducting developer recovered in said cleaning device to said developing device comprising:

a circulating passage means provided between said developing device and said cleaning device so as to communicate said developing device with said cleaning device;

discharging means for discharging the developer recovered in said cleaning device to said circulating passage means;

conveying means disposed in said circulating passage means for conveying said developer in said circulating passage means to said developing device, said conveying means having a downstream end and an upstream end, said conveying means being operable to convey said developer at said downstream end at a smaller rate than at said upstream end; and supplying means for supplying developer conveyed by said conveying means into said developing device.

13. A device according to claim 12, wherein said conveying means comprises a spiral means which rotates in said circulating passage means to convey said developer.

14. A device according to claim 13, wherein said spiral means has an upstream end and a downstream end, said downstream end of said spiral means having a smaller pitch than said upstream end.

15. A device according to claim 13, wherein said spiral means has an upstream end and a downstream end, said downstream end having at least one portion of less diameter than the diameter of said upstream end.

16. A device according to claim 12, wherein said supplying means is operable to move said developer at a faster rate than said discharging means.

17. A device according to claim 12, wherein said developing device and said cleaning device constitute a process unit which is detachably connected to said image forming apparatus.

18. A device for use with an image forming apparatus having a photosensitive drum and a developing device and a cleaning device disposed around said photosensitive drum for conducting developer recovered in said cleaning device to said developing device comprising:

a circulating passage means provided between said developing device and said cleaning device so as to communicate said developing device with said cleaning device;

discharging means for discharging developer recovered in said cleaning device to said circulating passage means;

conveying means disposed in said circulating passage means for conveying developer in said circulating passage means to said developing device; and supplying means for supplying developer conveyed by said conveying means into said developing device, said supplying means being operable to move said developer at a faster rate than said discharging means.

19. A device according to claim 18, wherein said developing device and said cleaning device constitute a process unit detachably mounted on said image forming apparatus.

20. A device for use with an image forming apparatus having a photosensitive drum and a developing device and a cleaning device disposed around said photosensitive drum for conducting developer recovered in said cleaning device to said developing device comprising:

a circulating passage means provided between said developing device and said cleaning device so as to communicate said developing device with said cleaning device;

discharging means being driven at least during operation of said photosensitive drum for discharging developer recovered in said cleaning device to said circulating passage means;

conveying means being driven at least during operation of said photosensitive drum for conveying developer in said circulating passage means to said developing device;

supplying means for supplying developer conveyed by said conveying means into said developing device;

said developing device having a supplying section and a developing section;

feeding means disposed in said developing device for feeding developer from said supplying section to said developing section;

operable drive means operably connected between said supplying means and said feeding means for driving said supplying means and said feeding means; and control means for controlling said operable drive means according to a physical property of said developer.

21. A device according to claim 20, wherein said physical property is the density of said developer, said control means comprising sensor means operable to sense the density of said developer.

22. A device according to claim 20, wherein said supplying means is disposed upstream of said feeding means.

23. A device according to claim 20 further comprising second drive means for driving said discharging means and said conveying means, said second drive means being capable of being operated independently of said operable drive means.

24. A device according to claim 20 further comprising photosensitive drum drive means, said operable drive means being operable to provide an interrelated drive between said discharging means, said conveying means, and said photosensitive drum drive means.

25. A device according to claim 20, wherein said developing device and said cleaning device constitute a process unit detachably mounted to said image forming apparatus.

26. A device for use with an image forming apparatus having a photosensitive drum and a developing device and a cleaning device disposed around the photosensitive drum for conducting developer recovered in said cleaning device to said developing comprising:

a circulating passage means interposed between said developing device and said cleaning device so as to communicate said developing device with said cleaning device;

discharging means for discharging developer recovered in said cleaning device to said circulating passage means;

conveying means disposed in said circulating passage means for conveying developer in said circulating passage means to said developing device;

a rotatable supplying means for supplying developer conveyed by said conveying means into said developing device, said supplying means comprising an axially elongate supply member having a first spiral portion for moving developer in one axial direction and a second spiral portion for moving developer in an axial direction opposite to said one axial direction, said supply member having an intermediate portion intermediate said first and second spiral portions, said intermediate portion having a plurality of substantially plate-like members extending substantially axially of said supplying member.

27. A device according to claim 26, wherein said developing device and said cleaning device constitute a process unit detachably mounted to said image forming apparatus.

28. A device for use with an image forming apparatus having a photosensitive drum and a developing device and a cleaning device disposed around said photosensitive drum for conducting developer recovered in said cleaning device to said developing device comprising;

a circulating passage means provided between said developing device and said cleaning device so as to communicate said developing device with said cleaning device;

discharging means for discharging developer recovered in said cleaning device to said circulating passage means;

conveying means disposed in said circulating passage for conveying developer in said circulating passage to said developing device;

supplying means for supplying developer conveyed by said conveying means into said developing device;

said developing device having a developer storage section defined by a sealing member for containing developer in an airtight condition prior to use; and said supplying means having an inlet means communicating with said developing device, said inlet means being on one side of said sealing member, said developer storage section being on the other side of said sealing member.

29. A device according to claim 28, wherein said developer storage section is disposed in an upper portion of said developing device, said sealing member is disposed at a lower portion of said developer storage section, and said inlet means of said supplying means is disposed beneath said sealing member.

30. A device according to claim 29, wherein said developer device has a supplying chamber and a developing roller chamber, feeding means feeding developer from said supplying chamber to said developing roller chamber, said inlet means being disposed upstream of said feeding means.

31. A device according to claim 29, wherein said developing device and said cleaning device constitute a process unit detachably mounted to said image forming apparatus.

32. A device for use with an image forming apparatus having a photosensitive drum and a developing device and a cleaning device disposed around the photosensitive drum for conducting developer recovered in said cleaning device to said developing device comprising:

a circulating passage means interposed between said developing device and said cleaning device so as to communicate said developing device with said cleaning device;

discharging means for discharging developer recovered in said cleaning device to said circulating passage means;

conveying means disposed in said circulating passage means for conveying developer in said circulating passage means to said developing device; and a rotatable supplying means for supplying developer conveyed by said conveying means into said developing device, said supplying means comprising an axially elongate supply member having a first spiral portion for moving developer in one axial direction and a second spiral portion for moving developer in an axial direction opposite to said one axial direction.

* * * * *

UNITED STATES PATENT OFFICE

CERTIFICATE OF CORRECTION

Patent No. 4,894,688 Dated Jan. 16, 1990

Inventor(s) Masami TANIGUCHI and Junichi TAKAMATSU

It is certified that error appears in the above-identified patent and that said Letters Patent is hereby corrected as shown below:

Claim 26, line 5, between "developing" and "comprising:" insert --device--.

Claim 30, line 2, change "developer" to --developing--

Signed and Sealed this

Eighth Day of October, 1991

*Attest:*

HARRY F. MANBECK, JR.

*Attesting Officer*

*Commissioner of Patents and Trademarks*